United States Patent [19]

Folkins et al.

[11] Patent Number: 5,032,872

[45] Date of Patent: Jul. 16, 1991

[54] DEVELOPING DEVICE WITH DUAL DONOR ROLLERS INCLUDING ELECTRICALLY BIASED ELECTRODES FOR EACH DONOR ROLLER

[75] Inventors: Jeffrey J. Folkins, Rochester; Eric J. Schneider, Webster; Joseph G. Schram, Liverpool, all of N.Y.

[73] Assignee: Xerox Corporation, Stamford, Conn.

[21] Appl. No.: 429,108

[22] Filed: Oct. 30, 1989

[51] Int. Cl.[5] ..... G03G 15/06; G03G 15/09

[52] U.S. Cl. ..... 355/259; 118/647; 118/651; 118/656; 118/661; 355/251; 355/253; 355/261

[58] Field of Search ..... 355/251, 253, 259, 260, 355/261, 245, 246; 118/647, 651, 656, 657, 661

[56] References Cited

U.S. PATENT DOCUMENTS

| | | | |
|---|---|---|---|
| 3,357,403 | 12/1967 | Donalies | 118/651 X |
| 3,893,418 | 7/1975 | Liebman et al. | 118/637 |
| 3,929,098 | 12/1975 | Liebman | 118/637 |
| 3,967,892 | 7/1976 | Whited | 355/251 |
| 3,998,185 | 12/1976 | Weiler | 118/651 |
| 4,083,326 | 4/1978 | Kroll et al. | 118/661 |
| 4,114,261 | 9/1978 | Wefles | 29/626 |
| 4,266,868 | 5/1981 | Bresina et al. | 355/253 |
| 4,529,295 | 7/1985 | Mayer | 355/261 |
| 4,847,655 | 7/1989 | Parker et al. | 355/251 X |
| 4,876,575 | 10/1989 | Hays | 355/259 |
| 4,913,348 | 4/1990 | Hays | 355/246 X |

FOREIGN PATENT DOCUMENTS

| | | | |
|---|---|---|---|
| 0166544 | 1/1986 | European Pat. Off. | 355/259 |
| 0160970 | 9/1983 | Japan | 355/251 |
| 0086068 | 5/1984 | Japan | 355/261 |

OTHER PUBLICATIONS

Xerox co-pending U.S. patent application Ser. No. 396,153 Filed Aug. 21, 1989 in the Name of Jeffrey J. Folkins.

*Primary Examiner*—Fred L. Braun
*Assistant Examiner*—Matthew S. Smith
*Attorney, Agent, or Firm*—H. Fleischer; J. E. Beck; R. Zibelli

[57] ABSTRACT

An apparatus for developing a latent image recorded on a photoconductive member in an electrophotographic printing machine having a reservoir for storing a supply of developer material and a magnetic rush roll for transporting material from the reservoir to each of two donor rolls. The developer material has carrier granules and toner particles. The donor rolls receive toner particles from the magnetic brush roll and deliver the toner particles to the photoconductive member at spaced locations in the direction of movement of the photoconductive member to develop the latent image recorded thereon.

1 Claim, 2 Drawing Sheets

Figure 1:
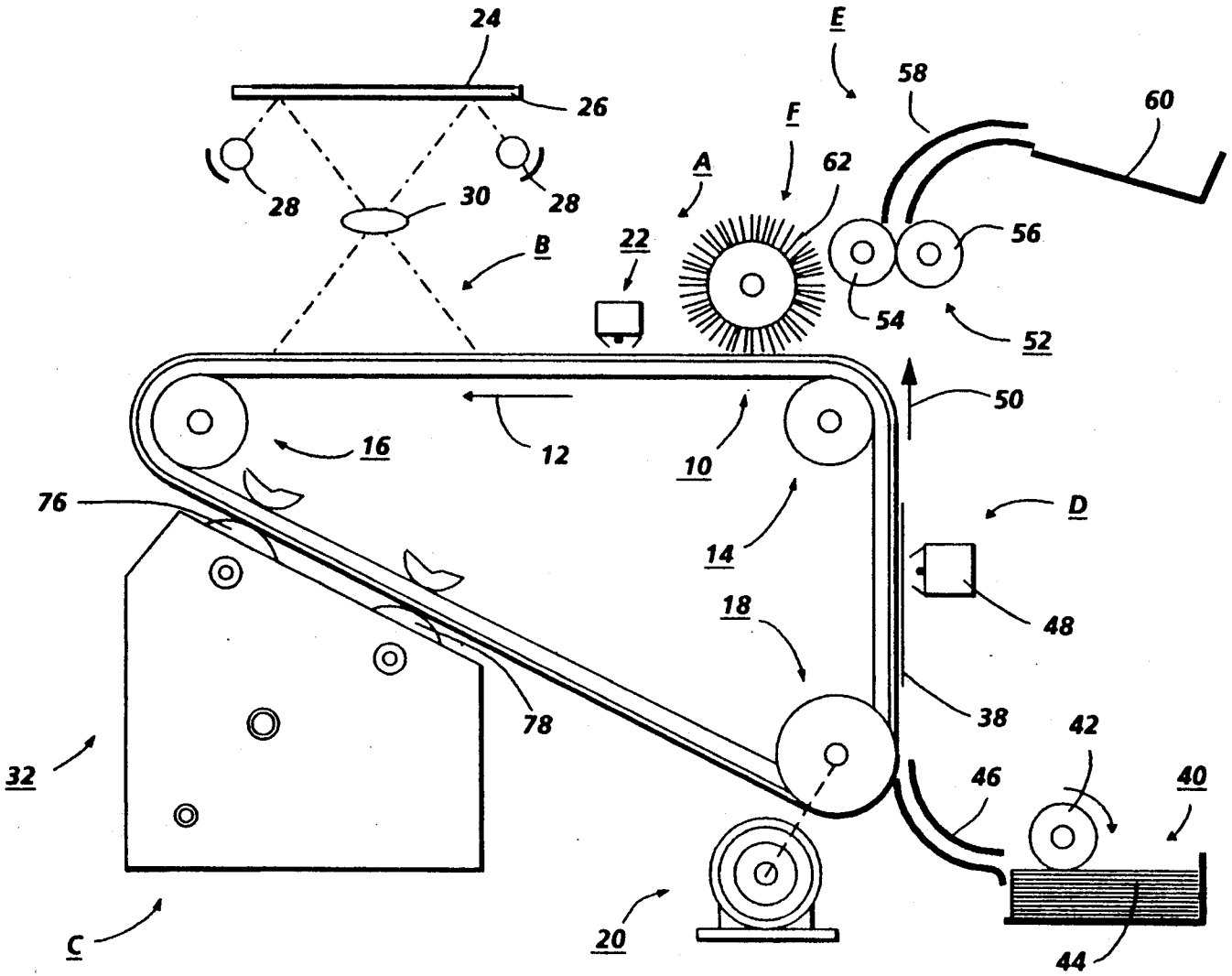

DEVELOPING DEVICE WITH DUAL DONOR ROLLERS INCLUDING ELECTRICALLY BIASED ELECTRODES FOR EACH DONOR ROLLER

This invention relates generally to an electrophotographic printing machine, and more particularly relates to an apparatus for developing a latent image recorded on a photoconductive member in a printing machine.

Generally, the process of electrophotographic printing includes the step of charging a photoconductive member to a substantially uniform potential to sensitize the surface thereof. The charged portion of the photoconductive surface is exposed to a light image of an original document being reproduced. This records an electrostatic latent image on the photoconductive member corresponding to the original document. The recorded latent image is then developed by bringing a developer material into contact therewith. This forms a toner powder image on the photoconductive member which is subsequently transferred to a copy sheet. Finally, the powder image is heated to permanently affix it to the copy sheet in image configuration.

A suitable developer material may be a two-component mixture of carrier granules having toner particles adhering triboelectrically thereto. The toner particles are attracted to, and adhere to, the electrostatic latent image to form a powder image on the photoconductive surface. Single component developers are also known: they have only toner particles, the particles having an electrostatic charge (for example, a triboelectric charge) so that they will be attracted to, and adhere to, the latent image on the photoconductive surface.

There are various known forms of development systems for bringing toner particles to a latent image on a photoconductive surface. One form includes a magnetic brush roll which picks up developer from a reservoir through magnetic attraction and carries the developer into proximity with the latent image. In a modification of the magnetic brush apparatus, the magnetic brush roll does not bring toner directly to the photoconductive surface but transfers toner to a donor roll which then carries the toner into proximity with the latent image. In single component scavengeless development, a donor roll is used with a plurality of electrode wires closely spaced therefrom in the development zone. An AC voltage is applied to the wires to form a toner cloud in the development zone and the electrostatic fields generated by the latent image attact toner from the cloud to develop the latent image. In single component jumping development, an AC voltage is applied to the donor roll, causing toner to be detached from the roll and projected towards the photoconductive surface. The toner is attached by the electrostatic fields generated by the latent image and the latent image is developed.

A development system using a magnetic roll and a donor roll was described by Toshiba at the 2nd International Congress on Advances in Non-impact Printing held in Washington, D.C. on Nov. 4–8, 1984, sponsored by the Society for Photographic Scientists and Engineers. The donor roll and magnetic roll were electrically biased and the magnetic roll transported a two component developer material to the nip defined by the two rolls where toner was attracted to the donor roll from the magnetic roll. The donor roll rotated synchronously with the photoconductive drum with the gap therebetween being about 0.20 millimeters. The large difference in potential between the donor roll and latent image recorded on the photoconductive drum caused the toner to jump across the gap from the donor roll to the latent image so as to develop the latent image.

U.S. Pat. No. 3,929,098 issued to Liebman on Dec. 30, 1975 also discloses an apparatus wherein a magnetic brush roll functions to transport a two-component developer to the nip between the magnetic roll and a donor roll. The toner particles of the developer are then transferred from the magnetic brush to the donor roll for transport to develop a latent image on a photoreceptor. This provides adequate loading of the donor roll with toner, to achieve development of the latent image an acceptable density.

Co-pending U.S patent application Ser. No. 396,153 filed Aug. 21, 1989 in the name of the present applicant also describes an apparatus wherein a magnetic roll transports two component developer to a transfer region wherein toner from the magnetic roll is transferred to a donor roll. The donor roll transports toner to a region opposed from a surface on which a latent image is recorded. A pair of electrode wires are positioned in the space between the surface and the donor roll and are electrically biased to detach toner from the donor roll to form a toner cloud. Detached toner from the cloud develops the latent image.

Other disclosures of apparatus employing two or more rollers for delivering toner to a photoconductive surface are as follows:

U.S Pat. No. 4,083,326 issued to Kroll et al. on Apr. 11, 1978 describes a development apparatus wherein two electrically-conductive brushes are used to transfer a single-component developer from a reservoir to a single applicator roller which delivers the developer to a photoconductive image member.

U.S. Pat. No. 4,266,868 to Bresina et al. on May 12, 1981 describes a development apparatus wherein a magnetic brush roller delivers a single component developer directly from a reservoir to a photoconductive surface and also transfers the developer from the reservoir to a second magnetic brush roller.

Other prior art disclosures of development apparatus are as follows:

U.S. Pat. No. 3,893,418 to Liebman et al. on Jul. 8, 1975 discloses an apparatus employing a donor roll for transporting toner from a hopper to a xerographic drum, and a pulse generator for applying an electrical pulse across the gap between the donor roll and the drum.

U.S. Pat. Nos. 3,998,185 and 4,114,261 to Weiler both disclose microfield donor rolls for transporting toner particles to a developing station. The donor rolls are formed from a plurality of segments, alternate ones of which are oppositely charged. The polarity of the charges reverses as the rolls rotate, so that the toner on the surface is agitated and readily transferred to the latent image.

Single component development systems appear to offer advantages of low cost and design simplicity but achieving high reliability may present a problem. Two component development systems on the other hand have been used extensively in many different types of printing machines and are well established but tend to be more complex and to require more space.

It is an object of the present invention to provide development apparatus which enables images of improved quality to be obtained with a high degree of reliability but without a substantial increase in the space requirement and cost of the apparatus.

In accordance with one aspect of the invention, there is provided an apparatus for developing a latent image recorded on a movable surface. The apparatus includes a reservoir for storing developer material comprising at least carrier and toner. A plurality of donor members are spaced apart from each other in the direction of movement of the surface. A common transport member is arranged to transport developer material from the reservoir and to supply toner therefrom to at least the plurality of donor members for delivery to the surface to develop the latent image recorded thereon.

In accordance with another aspect of the invention, there is provided an apparatus for developing a latent image recorded on a movable photoconductive surface. The apparatus includes a reservoir for storing a supply of carrier granules and toner particles, a magnetic brush roll, and at least two donor rolls. The magnetic brush roll are arranged to transport carrier granules and toner particles from the reservoir. The donor rolls both are arranged to receive toner particles from the magnetic brush roll and to deliver toner particles to the photoconductive surface at locations spaced apart from each other in the direction of movement of the photoconductive surface thereby to develop the latent image thereon.

Pursuant to still another aspect of the present invention, there is provided an electrophotographic printing machines of the type having an electrostatic latent image recorded on a movable photoconductive surface with the image being developed by toner particles supplied by a development apparatus from a reservoir of material comprising carrier granules and toner particles. The improved development apparatus includes a magnetic brush roll for transporting carrier granules and toner particles from the reservoir, and at least two donor rolls arranged to receive toner particles from the magnetic brush roll. Each of the donor rolls is positioned to transport toner particles closely adjacent the photoconductive surface so that toner particles are transferred from the donor rolls to the latent image at respective locations spaced apart from each other in the direction of movement of the photoconductive surface.

Figure 2:
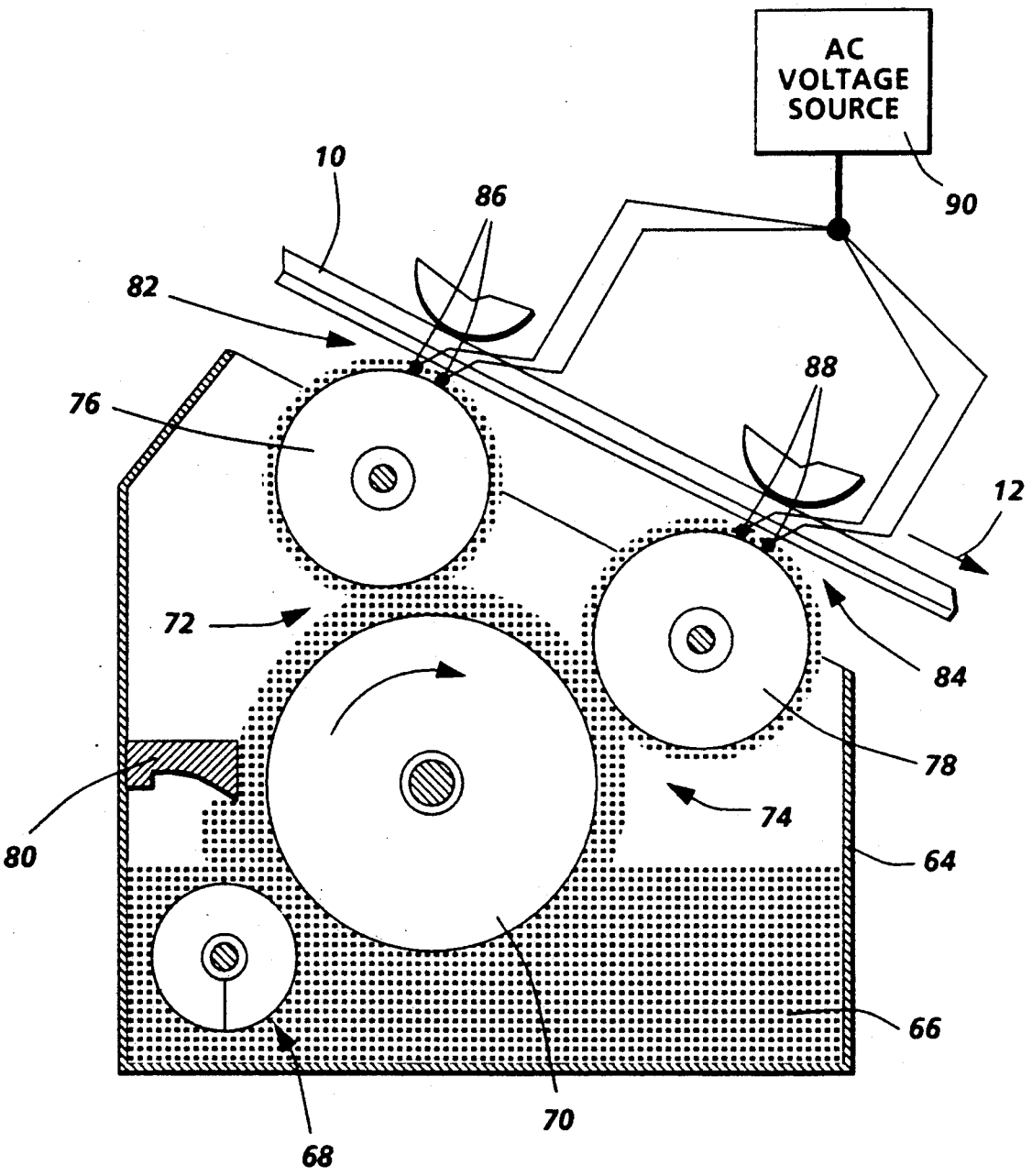

By way of example, an embodiment of the invention will be described with reference to the accompanying drawings, in which:

FIG. 1 is a schematic elevational view depicting an illustrative electrophotographic printing machine incorporating the development apparatus of the present invention therein; and FIG. 2 is a schematic elevational view showing the development apparatus of the FIG. 1 printing machine in greater detail.

In the drawings, like reference numerals have been used throughout to designate identical elements. FIG. 1 schematically depicts the various components of an illlustrative electrophotographic printing machine incorporating the development apparatus of the present invention. It will become evident from the following discussion that this development apparatus is equally well suited for use in a wide variety of electrostatographic printing machines and for use in ionographic printing machines.

Because the various processing stations employed in the FIG. 1 printing machine are well known, they are shown schematically and their operation will be described only briefly.

The printing machine shown in FIG. 1 employs a photoconductive belt 10 of any suitable type, which moves in the direction of arrow 12 to advance successive portions of the photoconductive surface of the belt through the various stations disposed about the path of movement thereof. As shown, belt 10 is entrained about rollers 14 and 16 which are mounted to be freely rotatable and drive roller 18 which is rotated by a motor 20 to advance the belt in the direction of the arrow 12.

Initially, a portion of belt 10 passes through a charging station A. At charging station A, a corona generation device, indicated generally by the reference numeral 22, charges a portion of the photoconductive surface of belt 10 to a relatively high, substantially uniform potential.

Next, the charged portion of the photoconductive surface is advanced through an exposure station B. At exposure station B, an original document 24 is positioned face down upon a transparent platen 26. Lamps 28 flash light onto the document 24 and the light that is reflected is transmitted through lens 30 forming a light image on the charged portion of the photoconductive surface. The charge on the photoconductive surface is selectively dissipated, leaving an electrostatic latent image on the photoconductive surface which corresponds to the original document 24 disposed upon transparent platen 26. The belt 10 then advances the electrostatic latent image to a development station C.

At development station C, a development apparatus indicated generally by the reference numeral 32, transports toner particles to develop the electrostatic latent image recorded on the photoconductive surface. The development apparatus 32 will be described hereinafter in greater detail with reference to FIG. 2. Toner particles are transferred from the development apparatus to the latent image on the belt, forming a toner powder image on the belt, which is advanced to transfer station D.

At transfer station D, a sheet of support material 38 is moved into contact with the toner powder image. Support material 38 is advanced to transfer station D by a sheet feeding apparatus, indicated generally by the reference numeral 40. Preferably, sheet feeding apparatus 40 includes a feed roll 42 contacting the uppermost sheet of a stack of sheets 44. Feed roll 42 rotates to advance the uppermost sheet from stack 44 into chute 46. Chute 46 directs the advancing sheet of support material 38 into contact with the photoconductive surface of belt 10 in a timed sequence so that the toner powder image developed thereon contacts the advancing sheet of support material at transfer station D.

Transfer station D includes a corona generating device 48 which sprays ion onto the back side of sheet 38. This attracts the toner powder image from the photoconductive surface to sheet 38. After transfer, the sheet continues to move in the direction of arrow 50 into a conveyor (not shown) which advances the sheet to fusing station E.

Fusing station E includes a fusing assembly, indicated generally by the reference numeral 52, which permanently affixes the transferred powder image to sheet 38. Preferably, fuser assembly 52 includes a heated fuser roller 54 and back-up roller 56. Sheet 38 passes between fuser roller 54 and back-up roller 56 with the toner powder image contacting fuser roller 54. In this way, the toner powder image is permanently affixed to sheet 38. After fusing, chute 58 guides the advancing sheet to catch tray 60 for subsequent removal from the printing machine by the operator.

Invariably, after the sheet of support material is separated from the photoconductive surface of belt 10, some residual toner particles remain adhering thereto. These residual particles are removed from the photoconductive surface at cleaning station F. Cleaning station F includes a pre-clean corona generating device (not shown) and a rotatably mounted fibrous brush 62 in contact with the photoconductive surface of belt 10. The pre-clean corona generating device neutralizes the charge attracting the particles to the photoconductive surface. These particles are cleaned from the photoconductive surface by the rotation of brush 62 in contact therewith. Subsequent to cleaning, a discharge lamp (not shown) floods the photoconductive surface with light to dissipate any residual charge remaining thereon prior to the charging thereof for the next successive imaging cycle.

Referring now to FIG. 2, there are shown the details of the development apparatus 32. The apparatus comprises a reservoir 64 containing developer material 66. The developer material 66 is of the two component type, that is it comprises carrier granules and toner particles. The reservoir includes augers, indicated at 68, which are rotatably-mounted in the reservoir chamber. The augers 68 serve to transport and to agitate the material within the reservoir and encourage the toner particles to adhere triboelectrically to the carrier granules. A magnetic brush roll 70 transports developer material from the reservoir to the loading nips 72, 74 of two donor rolls 76, 78. Magnetic brush rolls are well known, so the construction of roll 70 need not be described in great detail. Briefly the roll comprises a rotatable tubular housing within which is located a stationary magnetic cylinder having a plurality of magnetic poles impressed around its surface. The carrier granules of the developer material are magnetic and, as the tubular housing of the roll 70 rotates, the granules (with toner particles adhering triboelectrically thereto) are attracted to the roll 70 and are conveyed to the donor roll loading nips 72, 74. A metering blade 80 removes excess developer material from the magnetic brush roll and ensures an even depth of coverage with developer material before arrival at the first donor roll loading nip 72.

At each of the donor roll loading nips 72, 74, toner particles are transferred from the magnetic brush roll 70 to the respective donor roll 76, 78. Each donor roll transports the toner to a respective development zone 82, 84 through which the photoconductive belt 10 passes. Transfer of toner from the magnetic brush roll 70 to the donor rolls 76, 78 can be encouraged by, for example, the application of a suitable D.C. electrical bias to the magnetic brush and/or donor rolls. The D.C. bias (for example, aproximately 100 v applied to the magnetic roll) establishes an electrostatic field between the donor roll and magnetic brush rolls, which causes toner particles to be attracted to the donor roll from the carrier granules on the magnetic roll. The carrier granules and any toner particles that remain on the magnetic brush roll 70 are returned to the reservoir 64 as the magnetic brush continues to rotate. The relative amounts of toner transferred from the magnetic roll 70 to the donor rolls 76, 78 can be adjusted, for example by: applying different bias voltages to the donor rolls; adjusting the magnetic to donor roll spacing; adjusting the strength and shape of the magnetic field at the loading nips and/or adjusting the speeds of the donor rolls.

At each of the development zones 82, 84, toner is transferred from the respective donor roll 76, 78 to the latent image on the belt 10 to form a toner powder image on the latter. Various methods of achieving an adequate transfer of toner from a donor roll to a photoconductive surface are known and any of those may be employed at the development zones 82, 84. In FIG. 2, each of the development zones 82, 84 is shown as having the form described in the previously mentioned U.S patent application Ser. No. 396,153 i.e. electrode wires are disposed in the space between each donor roll 76, 78 and the belt 10. FIG. 2 shows, for each donor roll 76, 78, a respective pair of electrode wires 86, 88 extending in a direction substantially parallel to the longitudinal axis of the donor roll. The electrode wires are made from thin (i.e. 50 to 100$\mu$ diameter) tungsten wires which are closely spaced from the respective donor roll. The distance between each wire and the respective donor roll is within the range from about 10$\mu$ to about 40$\mu$ (typically approximately 25$\mu$) or the thickness of the toner layer on the donor roll. The wires are self-spaced from the donor rolls by the thickness of the toner on the donor rolls. To this end the extremities of the wires are supported by the tops of end bearing blocks that also support the donor rolls for rotation. The wire extremities are attached so that they are slightly below a tangent to the surface, including the toner layer, of the donor roll structure.

An alternating electrical bias is applied to the electrode wires by an AC voltage source 90. The applied AC establishes an alternating electrostatic field between each pair of wires and the respective donor roll, which is effective in detaching toner from the surface of the donor roll and forming a toner cloud about the wires, the height of the cloud being such as not to be substantially in contact with the belt 10. The magnitude of the AC voltage is relatively low, for example in the order of 200 to 500 volts peak a frequency ranging from about 3 kHz to about 10 kHz. A DC bias supply (not shown) applied to each donor roll 76, 78 establishes electrostatic fields between the belt 10 and donor rolls for attracting the detached toner particles from the clouds surrounding the wires to the latent image recorded on the photoconductive surface of the belt. At a spacing ranging from about 10$\mu$ to about 40$\mu$ between the electrode wires and donor rolls, an applied voltage of 200 to 500 volts produces a relatively large electrostatic field without risk of air breakdown. The use of a dielectric coating on either the electrode wires or donor roller helps to prevent shorting of the applied AC voltage.

After development, toner may be stripped from the donor rolls 76, 78 by respective cleaning blades (not shown) so that magnetic roll 70 meters fresh toner to clean donor rolls. As successive electrostatic latent images are developed, the toner particles within the developer material 66 are depleted. A toner dispenser (not shown) stores a supply of toner particles. The toner dispenser is in communication with reservoir 64 and, as the concentration of toner particles in the developer material is decreased, fresh toner particles are furnished to the developer material in the reservoir. The auger 68 in the reservoir chamber mix the fresh toner particles with the remaining developer material so that the resultant developer material therein is substantially uniform with the concentration of toner particles being optimized. In this way, a substantially constant amount of toner particles is in the reservoir with the toner particles having a constant charge.

The use of more than one development zone, for example two development zones as at 82, 84 in FIG. 2, is desirable to ensure satisfactory development of a latent image, particularly at increased process speeds. If required, the development zones can have different charateristics, for example, through the application of a different electrical bias to each of the donor rolls. Thus, the characteristics of one zone may be selected with a view to achieving optimum line development, with the transfer characteristics of the other zone being selected to achieve optimum development of solid areas. The apparatus shown in FIG. 2 combines the advantage of two development nips with the well established advantage offered by use of magnetic brush technology with two-component developer namely high volume reliability. The combined advantages are achieved, however, with only a single magnetic brush roll 70, enabling a significant reduction in cost and a significant saving in space to be achieved compared with apparatus in which there is a respective magnetic brush roll for each donor roll. If more than two donor rolls are used then, depending on the layout of the system, it may be possible for a single magnetic brush roll to supply toner to more than two donor rolls.

In the arrangement shown in FIG. 2, the donor rolls 76, 78 and the magnetic brush roll 70 can be rotated either "with" or "against" the direction of motion of the belt 10.

The two-component developer 66 used in the apparatus of FIG. 2 may be of any suitable type. However, the use of an electrically-conductive developer is preferred because it eliminates the possibility of charge build-up within the developer material on the magnetic brush roll which, in turn, could adversely affect development at the second donor roll. By way of example, the carrier granules of the developer material may include a ferromagnetic core having a thin layer of magnetite overcoated with a non-continuous layer of resinous material. The toner particles may be made from a resinous material, such as a vinyl polymer, mixed with a coloring material, such as chromogen black. The developer material may comprise from about 95% to about 99% by weight of carrier and from 5% to about 1% by weight of toner.

It is, therefore, apparent that there has been provided in accordance with the present invention, an apparatus for developing a latent image that fully satisfies the aims and advantages hereinbefore set forth. While this invention has been described in conjunction with a specific embodiment thereof, it is evident that many alternatives, modifications, and variations will be apparent to those skilled in the art.

Accordingly, it is intended to embrace all such alternative, modifications and variations that fall within the spirit and broad scope of the appended claims.

We claim:

1. An apparatus for developing a latent image recorded on a movable photoconductive surface, including:

a reservoir for storing a supply of electrically conductive substantially monocolor developer material comprising at least carrier granules and toner particles;

a magnetic brush roll; and at least two donor rolls, said magnetic brush roll being arranged to transport carrier granules and toner particles from said reservoir, and said donor rolls both being arranged to receive toner particles from said magnetic brush roll and to deliver toner particles to the photoconductive surface at locations spaced apart from each other in the direction of movement of the photoconductive surface thereby to develop the latent image thereon;

at least one electrode member positioned between each one of said donor rolls and the photoconductive surface; and means for electrically biasing said electrode member to detach toner particles from said donor roll to form a cloud of toner particles in the region between said donor roll and the photoconductive surface.

* * * * *